US006896494B2

(12) United States Patent
Sunaga et al.

(10) Patent No.: US 6,896,494 B2
(45) Date of Patent: May 24, 2005

(54) CANNED PUMP

(75) Inventors: Hideki Sunaga, Tokyo (JP); Shiro Nakamura, Tokyo (JP); Kazunori Yamada, Tokyo (JP); Katsuhiro Machida, Gunma (JP); Yoshinori Asayama, Itami (JP); Hiroyuki Kamioka, Tokyo (JP); Satoshi Kuramochi, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/354,180

(22) Filed: Jan. 30, 2003

(65) Prior Publication Data

US 2004/0037719 A1 Feb. 26, 2004

(30) Foreign Application Priority Data

Jan. 30, 2002 (JP) ..... 2002-022336

(51) Int. Cl.[7] ..... F04B 49/06

(52) U.S. Cl. ..... 417/423.1; 310/64; 361/701; 417/44.1

(58) Field of Search ..... 417/423.8, 423.1, 417/423.7, 423.14, 366, 410, 410.4, 44.1; 439/485, 196; 310/67 R, 68 R, 64, 71, 89; 361/701

(56) References Cited

U.S. PATENT DOCUMENTS 4,430,590 A * 2/1984 Davis ..... 310/67 R
4,814,651 A * 3/1989 Elris et al. ..... 310/88
5,297,001 A * 3/1994 Sterling ..... 361/717
5,969,445 A * 10/1999 Horiuchi et al. ..... 310/64
6,091,174 A 7/2000 Genster
6,111,334 A 8/2000 Horski et al.
6,177,740 B1 * 1/2001 Burns ..... 310/68 R
6,450,786 B1 9/2002 Koch et al.
6,568,193 B1 * 5/2003 Cahill ..... 62/3.2
6,661,134 B2 * 12/2003 Sunaga et al. ..... 310/64
6,704,202 B1 * 3/2004 Hamaoka et al. ..... 361/704

FOREIGN PATENT DOCUMENTS

| | | |
|---|---|---|
| EP | 1 085 213 A2 | 3/2001 |
| JP | 2001-304198 A | 10/2001 |
| WO | WO 00/46507 A1 | 8/2000 |

* cited by examiner

*Primary Examiner*—Michael Koczo, Jr.
(74) *Attorney, Agent, or Firm*—Foley & Lardner LLP

(57) ABSTRACT

Disclosed is a canned pump comprising a housing, a rotor contained in the housing, a circuit substrate supported on the housing, semi-conductor means for power control attached to the circuit substrate, an end cover attached the housing to cover the circuit substrate, an a heat sink having heat radiating means for cooling the semi-conductor means for power control. The semi-conductor means for power control is mounted on a surface of the circuit substrate facing to the end cover. The heat sink attached to the circuit substrate to cover the semi-conductor means for power control.

20 Claims, 11 Drawing Sheets

CANNED PUMP

This application claims priority from Japanese Patent Application 2002-022336, filed Jan. 30, 2002, which is incorporated herein by reference in its entirety.

BACKGROUND OF THE INVENTION

1. Field of the Invention

The present invention relates to a canned pump, more specifically, to a canned pump capable of obtaining good cooling capability and minimizing manufacturing cost.

2. Description of the Prior Art

Hitherto, a conventional canned pump is consisted to assemble a driving circuit for driving the pump in a housing and to cover the driving circuit by a lower case. A means for cooling a MOS type FET (Metal Oxide Semiconductor type Field Effect Transistor) which is a portion of the driving circuit, an end cover for covering the MOS type FET is used as a heat sink for cooling the MOS type FET.

Therefore, in the conventional canned pump, the MOS type FET is fixed to the end cover by means of screws and an electrical lead line of the MOS type FET is soldered to a circuit substrate of the driving circuit to not apply a stress to the soldered part after the circuit substrate is fixed to the end cover (see Japanese Laid-Open Publication No.2001-304198 as the similar art).

In such a conventional canned pump, it is necessary to make the end cover by a material having good heat conductance, for example, aluminum since the end cover is used as the heat sink.

However, since the end cover has a cup-like shape, it is difficult to produce it by extruding aluminum.

If the end cover is produced by die-casting of aluminum, deterioration of heat conductivity is caused.

If the end cover is produced by forging of aluminum which has good heat conductance, manufacturing cost is increased.

On the other hand, in the aforementioned conventional canned pump, a sequence of process of soldering the electrical lead line of the MOS type PET is also limited.

Under such circumstances, a further improvement, in the conventional canned pump is required.

SUMMARY OF THE INVENTION

It is therefore an object of the present invention to provide a canned pump capable of maintaining good cooling without having function of heat sink in the end cover.

To accomplish the above object, the canned pump according to the present invention comprises a housing, a rotor contained in the housing, a circuit substrate attached within the housing, semi-conductor means for power control attached to the circuit substrate, an end cover attached to the housing to cover the circuit substrate, and a heat sink having heat radiating means for cooling the semi-conductor means for power control.

It should be noted that the semi-conductor means for power control is mounted on a surface of the circuit substrate facing to the end cover and the heat sink is attached to the circuit substrate to cover the semiconductor means for power control.

The canned pump further comprises cooling means for cooling the heat sink. The cooling means is, for example, composed of a window formed in the end cover through which the heat radiating means is exposed to the atmosphere.

In one embodiment, the heat radiating means of the heat sink is composed of a plurality of fins.

The semi-conductor means for power control is composed of, for example, a MOS type FET.

A signal control circuit in a circuit assembly is attached to the other surface of the circuit substrate opposite to the surface to which the semi-conductor means for power control is attached.

The rotor carries out a pump operation of the canned pump and has a positioning pin inserted into a through hole provided in the circuit substrate to position the substrate to the rotor.

The housing is formed with at least one seat for mounting the circuit substrate thereon and at least one supporting part for fixing the circuit substrate thereto.

The canned pump further comprises a stator assembly which is contained in the housing and which includes a core having projections which are inserted in grooves formed in the housing. The core is locked in the housing by lock means at the final step of the insertion of the core in the housing. A clearance between the circuit substrate and a base of the positioning pin is also provided and the poisoning pin is formed in conical shape.

The positioning pin acts as a gate of melted resin when forming a resinous water-resistant lower case for the rotor. The lower case is attached to the housing.

At least one groove is formed around the base of the positioning pin.

The rotor has also a plurality of terminal pins for engaging with circumferential portions of the circuit substrate, after that engagement, the pins are supported on the circuit substrate by welding.

The terminal pins are disposed in positions which are spaced at angle of 120 degree from each other centering on the housing.

The fins of the heat sink are inserted into the window formed in the end cover. In one embodiment, the lower case is formed integrally with the housing by die-casting.

DETAILED DESCRIPTION OF THE PREFERRED EMBODIMENTS

Some embodiments of a canned pump according to the present invention will be explained in connection with FIGS. 1 to 15 below.

Figure 1:
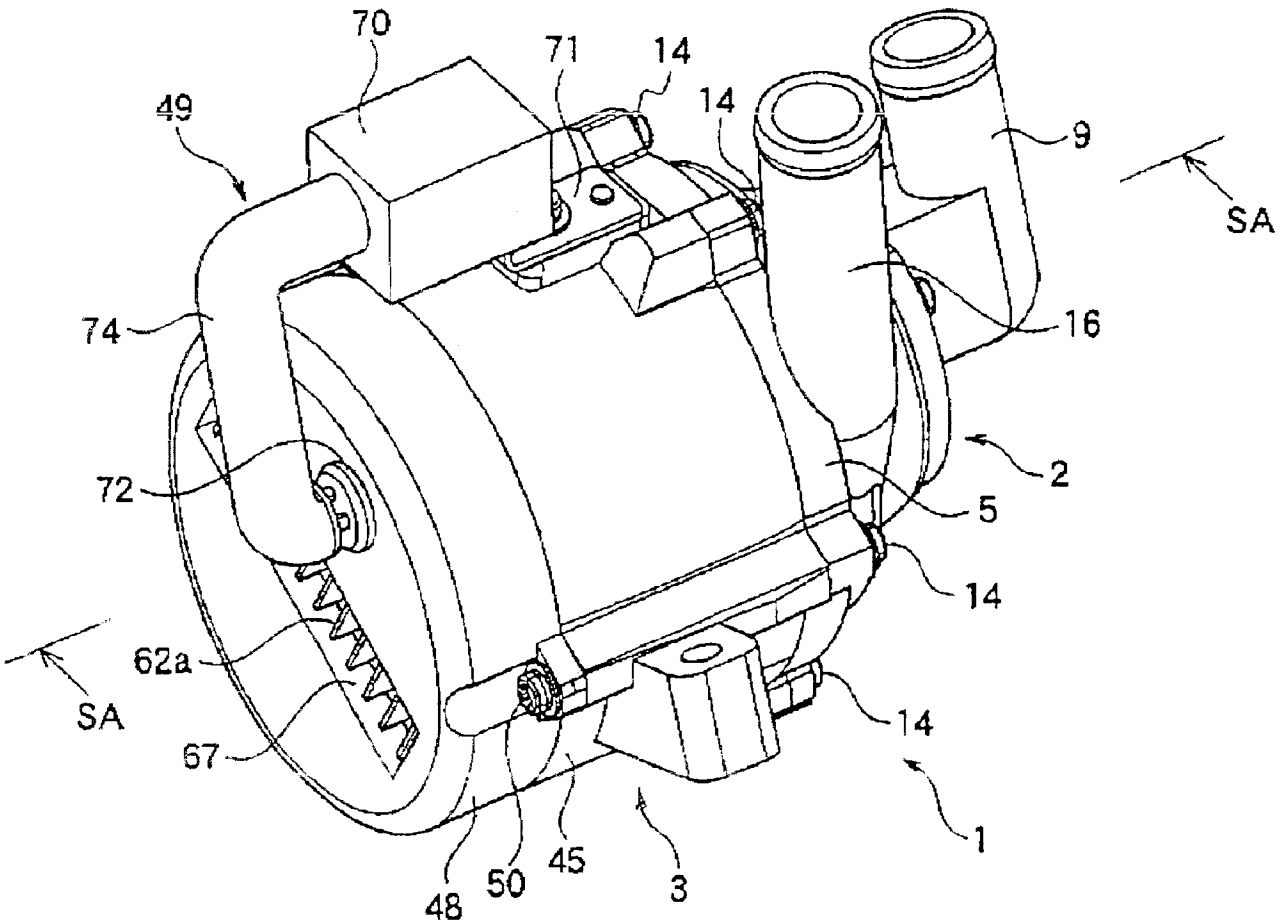
FIG. 1 is a perspective view showing one embodiment of a canned pump according to the present invention.
Figure 2:
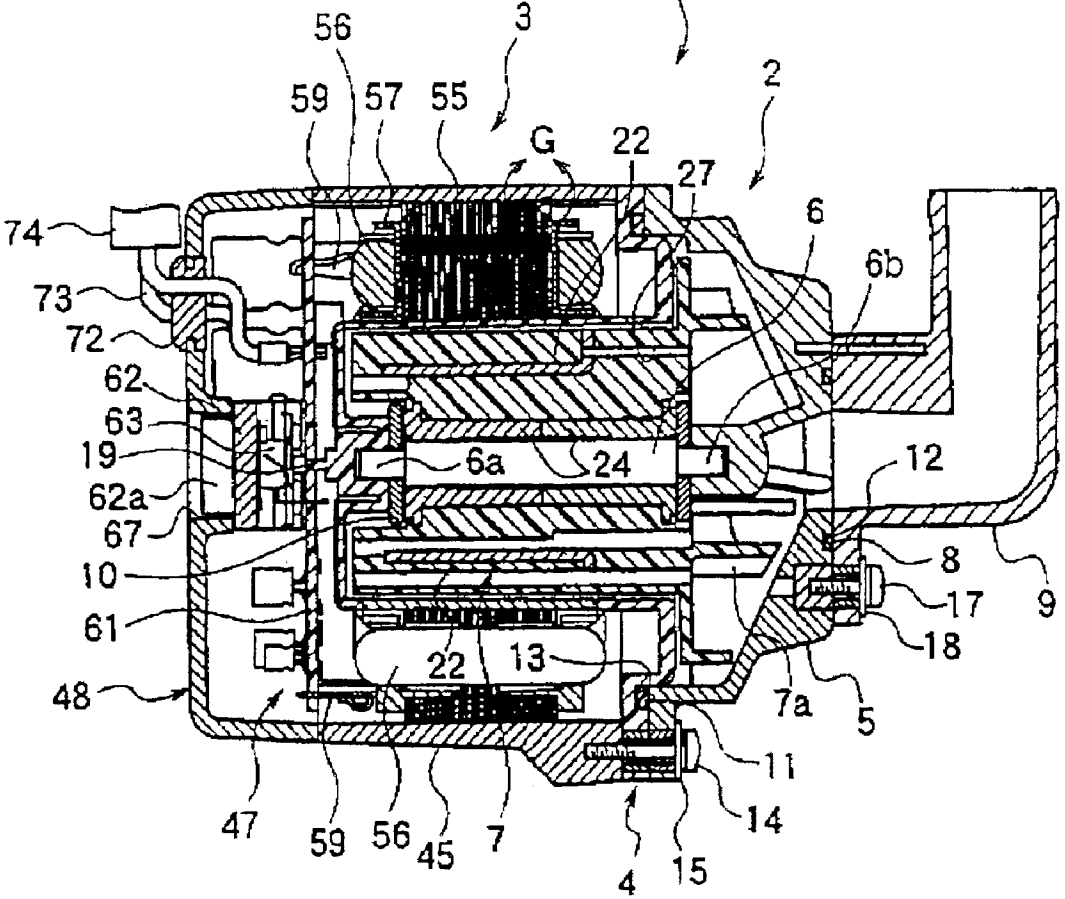
FIG. 2 is a sectional view taken along the SA—SA line in FIG. 1.
Figure 3:
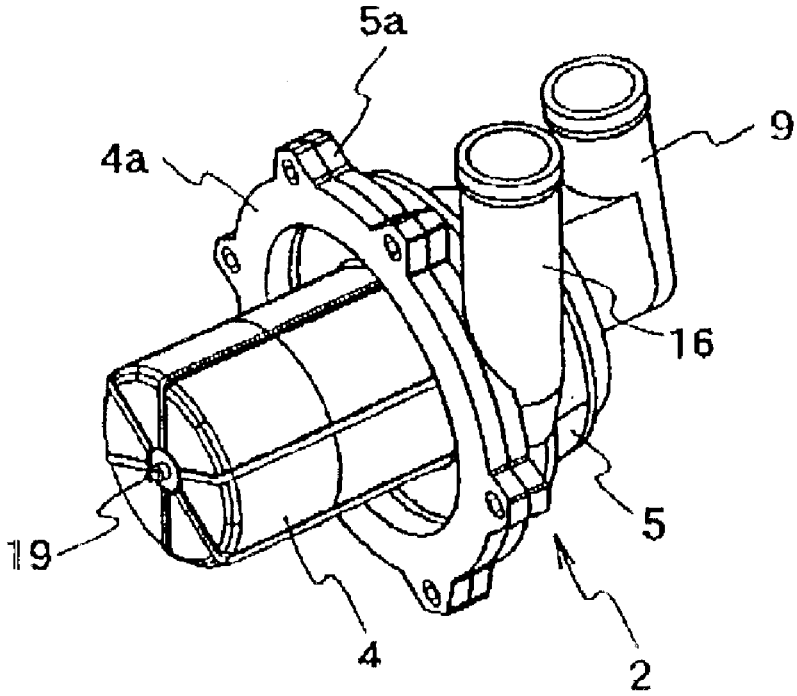
FIG. 3 is a perspective view showing only an upper assembly in FIG. 1.
Figure 4:
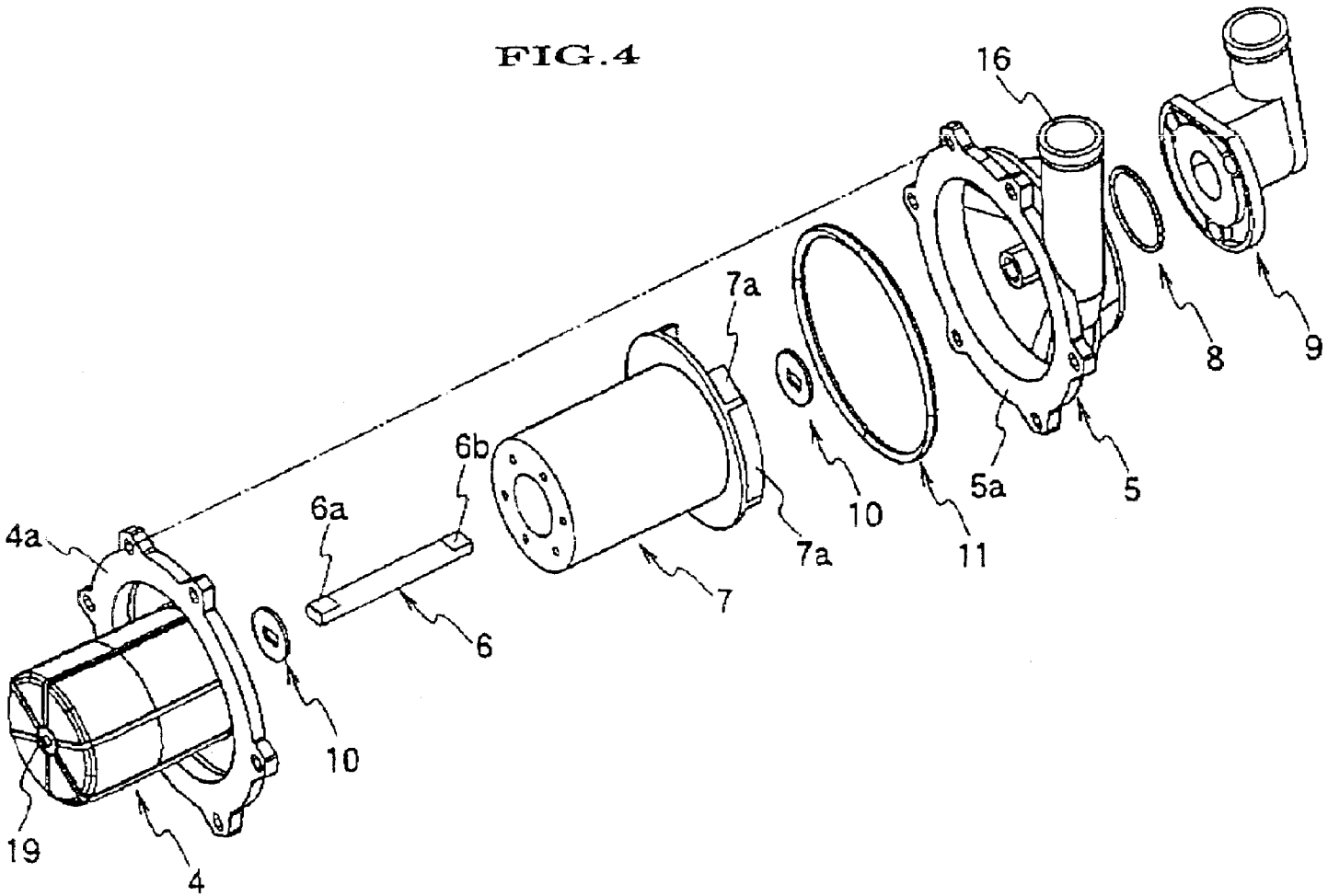
FIG. 4 is an exploded perspective view of the upper assembly shown in FIG. 3.

In FIGS. 1 and 2, reference numeral 1 denotes the canned pump, The canned pump comprises an upper assembly 2 and a lower assembly 3.

The upper assembly 2 includes a lower case 4, an upper case 5, a shaft 6 having cylindrical shape in section, whose opposite ends 6*a* and 6*b* are fixed to the lower case 4 and upper case 5, respectively, a rotor 7 and an inlet pipe 9.

The inlet pipe 9 is fastened through a first O-ring 8 to the upper case 5 by means of screws 14 and washers 15 as shown in FIG. 2. A flange 4*a* of the lower case 4 and a flange 5*a* of the upper case are fixed mutually by means of the screws 14 and washers 15 (see FIG. 3), while a second O-ring 11 may be disposed between the lower and upper cases 2 and 5 (see FIG. 2).

Sims 10, 10 may also be disposed between the end 6*a* and lower case 4 and between the end 6*b* and upper case 5. Reference numeral 16 denotes an outlet pipe formed on the upper case 5. The upper case 5 is provided with a first concave portion 12 in which the first O-ring 8 is inserted and the lower case 4 is provided with a second concave portion 13 in which the second O-ring 11 is inserted.

Reference numeral 7*a* denotes an impeller of the rotor 7. The lower case 4 is formed in cylindrical shape from a synthetic resin.

Figure 5:
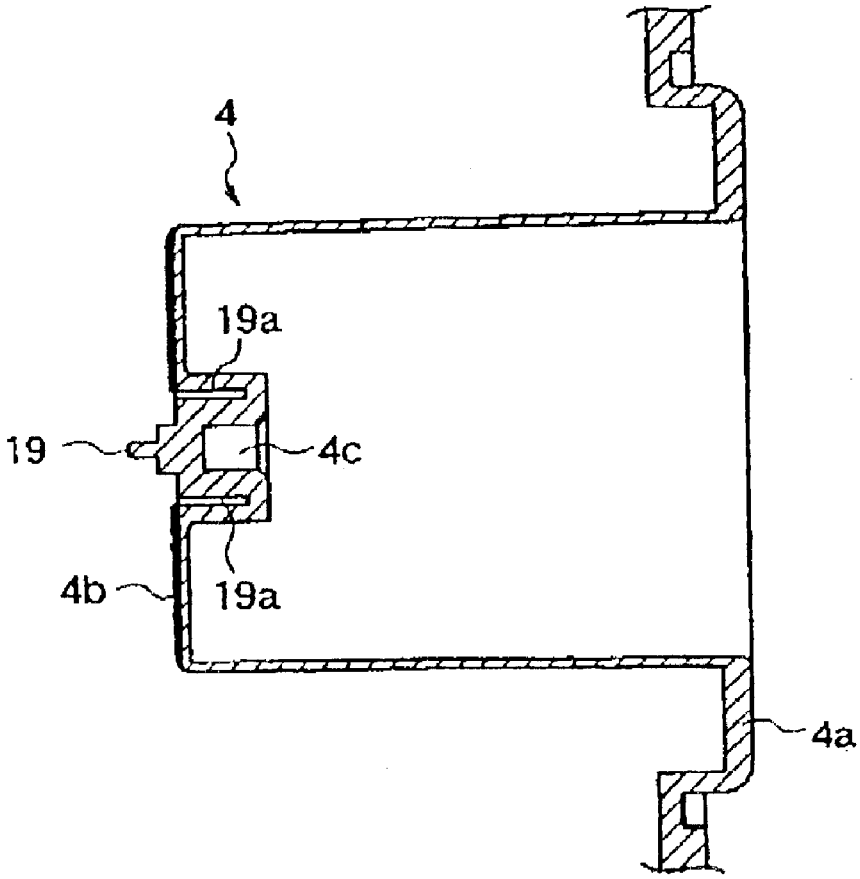
FIG. 5 is a sectional view of a lower case shown in FIG. 4.

As shown in FIG. 5, the lower case 4 is formed with at an inside of the bottom 4*b* an engaged part 4*c* with which the shaft 6 is engaged and at an outside of the bottom 4*b* a positioning pin 19 which is inserted into a through hole 64 provided in a circuit substrate 61 of a circuit assembly 47 as described hereinafter.

The positioning pin 19 may be not only cylindrical but also conical.

The positioning pin 19 also constitutes one of gates of a molding for forming the lower case 4 as shown in FIG. 5.

The rotor 7 is formed into cylindrical shape in section and has four magnets 21 arranged adjacent to the circuit substrate 61 as described below, a hollow yoke 22 arranged inwardly of the magnets 21, a resinous longitudinal tube 23 and a hollow cylindrical bearing 24 arranged inside of the tube 23, as shown in FIGS. 6 to 12. The rotor 7 is supported rotatably through the bearing 24 on the shaft 6. Generally speaking, when the rotor is rotated, liquid is introduced into the inlet pipe 9 and then is discharged through the rotor from the outlet pipe 16 by a pump operation of the rotor.

The magnets 21, yoke 22, bearing 24 and tube 23 are assembled integrally in forming and hardening a melted material for the tube 23 to form the rotor 7. The magnets 21 can be employed as sensor magnets by lengthening the magnets 21 than the yoke 22 to direct perpendicularly a direction of magnetic flux of the magnets to a radial direction of the rotor.

Figure 7:
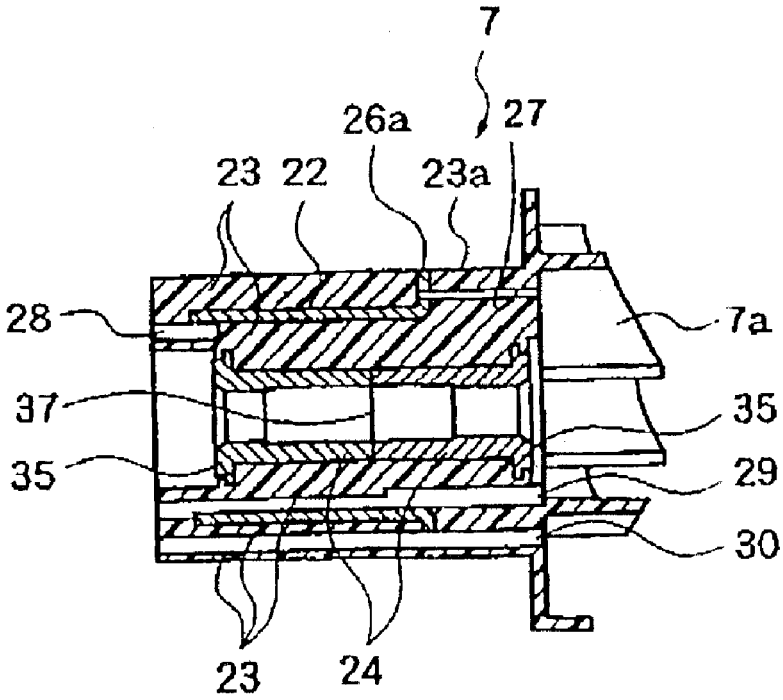
FIG. 7 is a sectional view taken along the SB—SB line in FIG. 6.

At the time of forming the tube 23, it is possible to hold the yoke 22 longitudinally (rightward and leftward in FIG. 7). Positions of the magnets 21 and bearing 24 to the yoke 22 are together decided. In other words, the rotor 7 can be formed by forming of one time to lower cost for producing.

More specifically, one end 22*a* of the yoke 22 is provided with a flange 26 which has two through holes 26 for positioning in which pins of a forming die (not shown) can be inserted and the other end 22*b* of the yoke 22 is provided with positioning holes 28 for inserting pins (not shown) of the forming die to cause the yoke 22 to hold longitudinally (rightward and leftward in FIG. 7), further an inner radial surface of the yoke 22 can be held by one or more pins (not shown) of the forming die.

Figure 6:
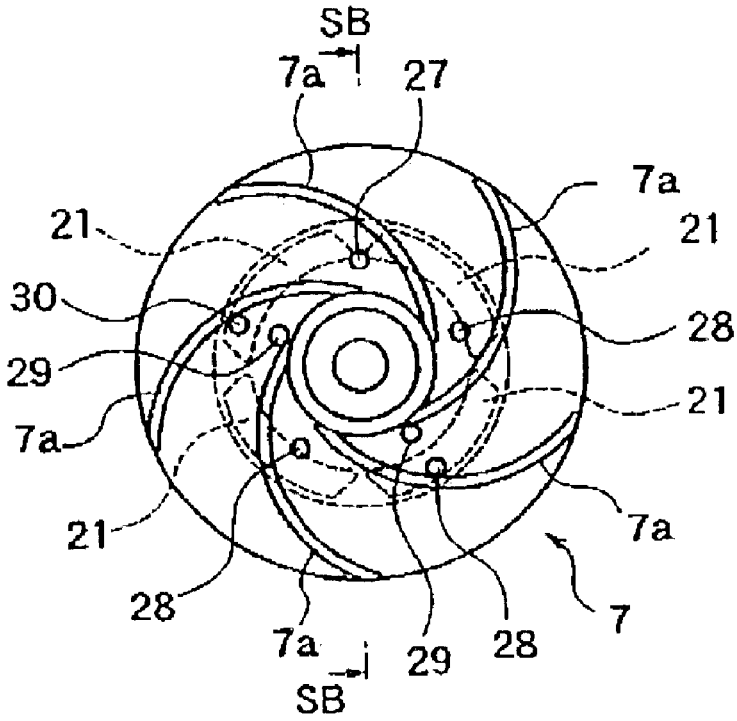
FIG. 6 is a front view from the side of an impeller of a rotor shown in FIG. 4.

In FIGS. 6 and 7, reference numerals 29, 29 denote holes in which pins (not shown) of the forming die are held. In FIG. 6, reference numeral 27 denotes a hole capable of inserting a pin (not shown) of the forming die which is also engaged in one of the through holes 25 of the flange 26 in the yoke 22.

An outer circumferential end 26*a* of the flange 26 extends to a position extends to a position close to an outer surface 23*a* of the tube 23 in the rotor 2, in other wards, a position exposed from the outer surface 23*a* to form the exposed portion in balance correcting of the rotor.

Reference numeral 30 denotes a hole for, positioning the aforementioned pin (not shown) to hold the circumferential end 26*a* of the flange 26 in the yoke 22, formed in the tube 23. Positions of the holes 29 can be used to position out polarity of the magnets 21 when magnetizing them.

Figure 8:
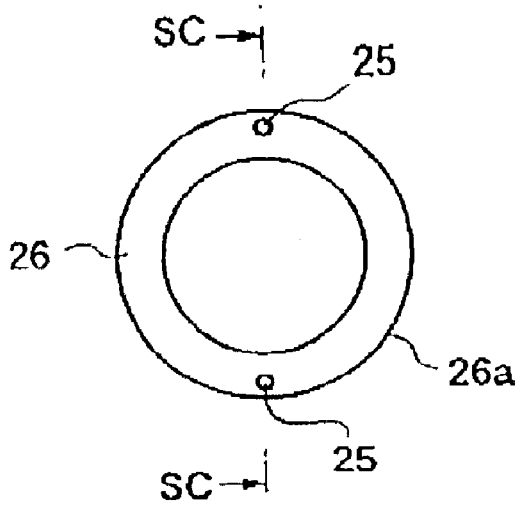
FIG. 8 is a front view of a yoke shown in FIG. 7.
Figure 9:
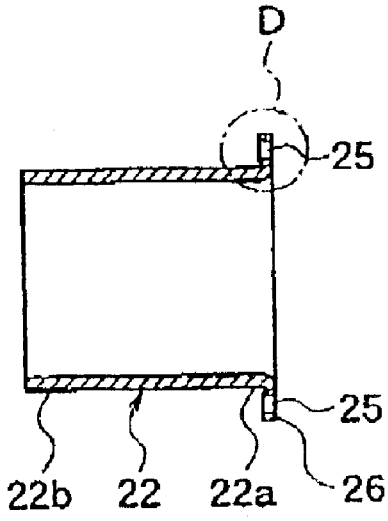
FIG. 9 is a sectional view taken along the SC—SC line in FIG. 7.
Figure 10:
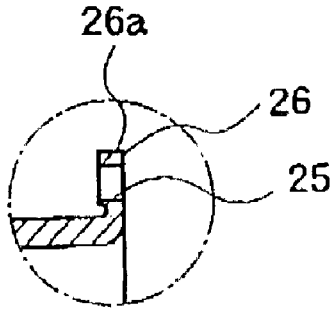
FIG. 10 is an enlarged sectional view of a portion D in FIG. 9.
Figure 11:
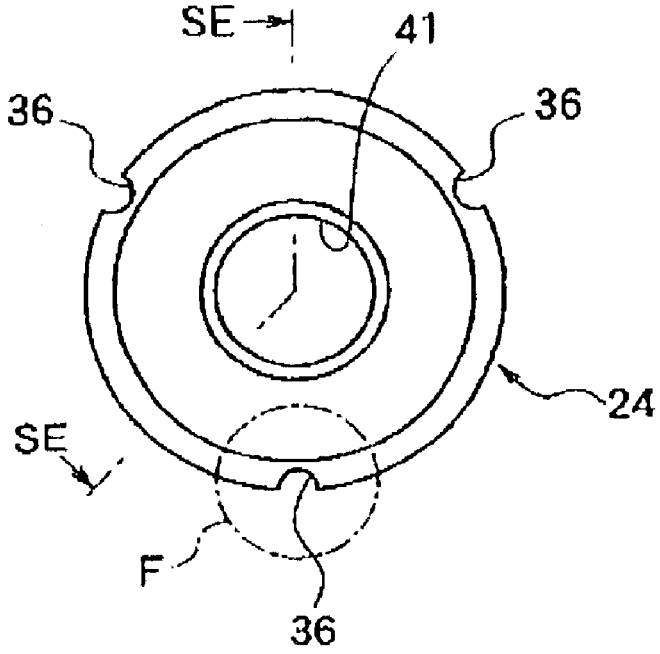
FIG. 11 is a front view of a bearing shown in FIG.7.

The yoke 22 will be explained in further detail in connection with FIGS. 8 to 10 as follows.

The yoke 22 is formed in hollow cylindrical shape having internal diameter of 30 mm and length of 38 mm. An average thickness of wall of the yoke is 2 mm and the minimum thickness is 1.9 mm. Material of the yoke is for example, SPCE, it's surface is treated with suitable rust proofing.

The circumferential end 26*a* of the flange 26 has a diameter of 44 mm and the through holes 25 are spaced 39 mm. namely, each of the holes is disposed at a position of 14.9 mm from the center line of the yoke. A diameter of each of the through holes is 2 mm. The flange is also bent perpendicularly to the yoke 22 with the minimum curvature of bending as shown in detail in FIG. 10.

The bearing 24 is formed from a material having a homogeneous carbon of high density, Hs 60 more or including PPS (polyphenylene sulphide) therein. The flanges 35 are formed at the opposite ends in the longitudinal direction of the bearing 24. The outer circumferential end of each flange of the bearing 24 is provided with at least one shoulder 36 in which a portion of melted resin of the tube 23 is inserted when the tubes formed. In the embodiment shown in FIG. 11, three shoulders are formed on each of the flanges. The three shoulders 36 are arranged at angular positions spaced equally by angle of 120 degree. Each of these shoulders has depth of 1.5 mm, for example.

Figure 12:
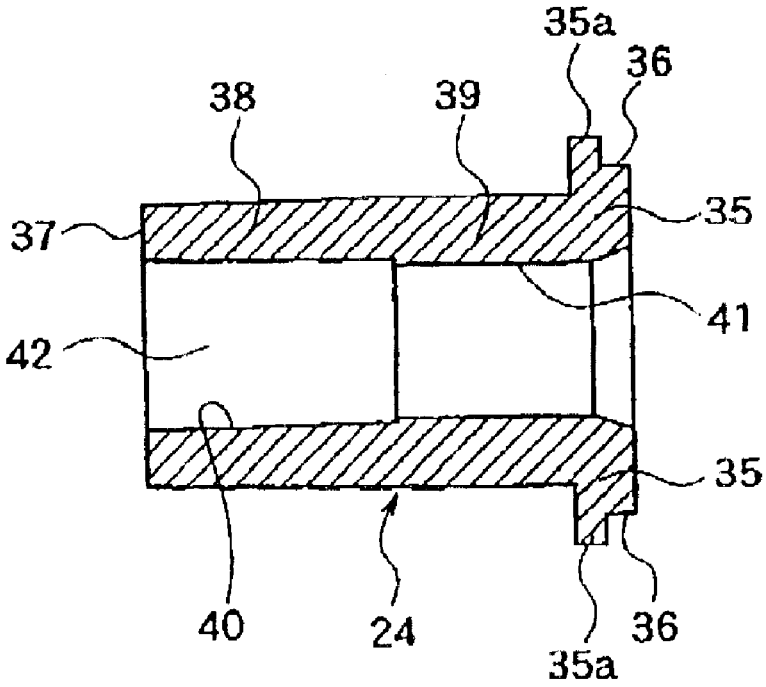
FIG. 12 is a sectional view taken along the SE—SE line in FIG. 11.
Figure 13:
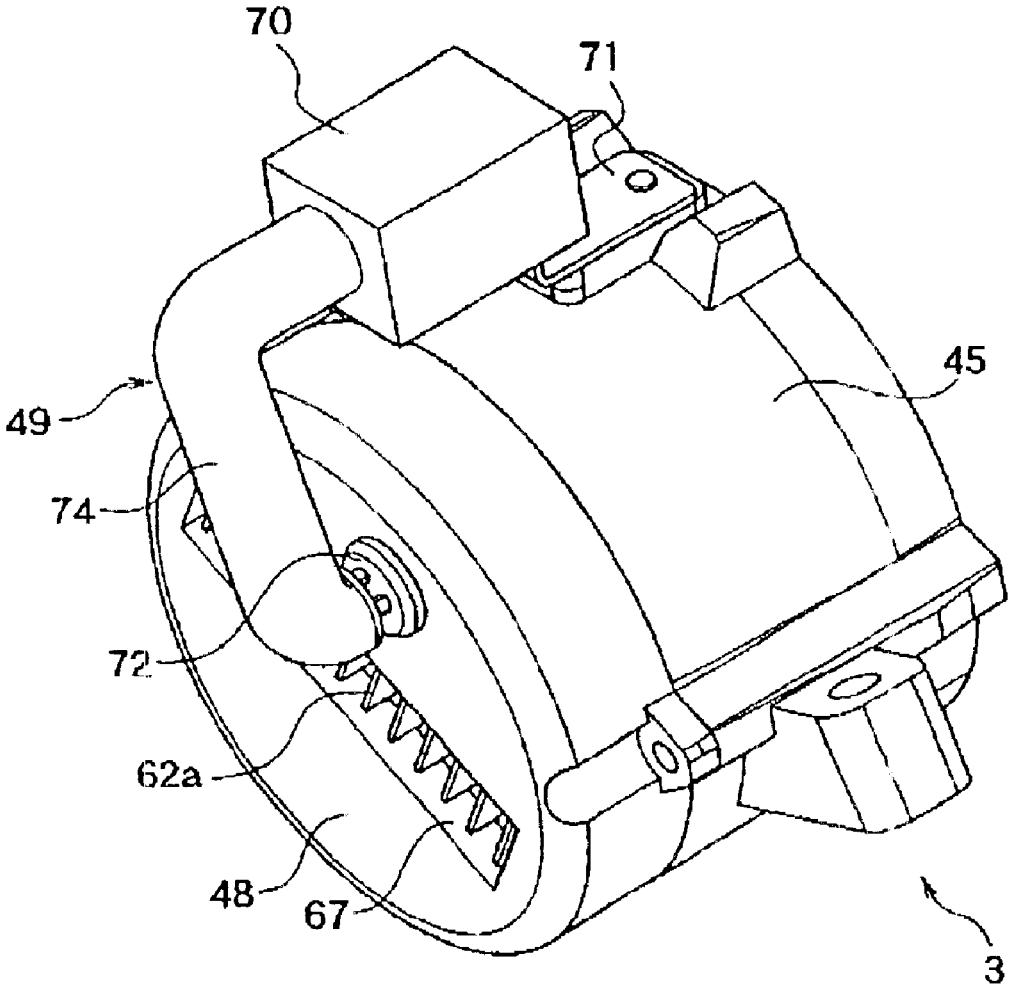
FIG. 13 is a perspective view showing only a lower assembly in FIG. 1.

In the embodiment shown in FIG. 7, the bearing 24 is composed of two sections which are separated longitudinally of the bearing and which are connected at a separated area 37 One section 39 of these sections is shown in FIG. 12. The section 39 has a through hole 41 adjacent to the flange 35 and a through bole 42 adjacent to the through hole 41 and formed in an end portion 38 from the flange 35.

The through hole 42 is provided with a tapered portion 40 which is formed to widen toward the separated area 37 as shown in FIG. 12. The through hole 41 has internal diameter of, for example, 8 mm and the maximum internal diameter of the tapered portion 40 is 8.5 mm.

Formed between the outer circumferential surface of the shaft 6 and the tapered portion 40 of the bearing 24 is a space in which liquid can be contained to enhance circularity of the liquid.

For example, the entire length of the bearing 24 is about 25 mm. The through hole 42 having the tapered portion 40 is formed throughout an area from a position of 12 mm from the end of the flange 35 to the separated area 37 to form a stepping difference of 0.25 mm on one side or a stepping difference of adding draft angle of the forming die to the former stepping difference.

Figure 14:
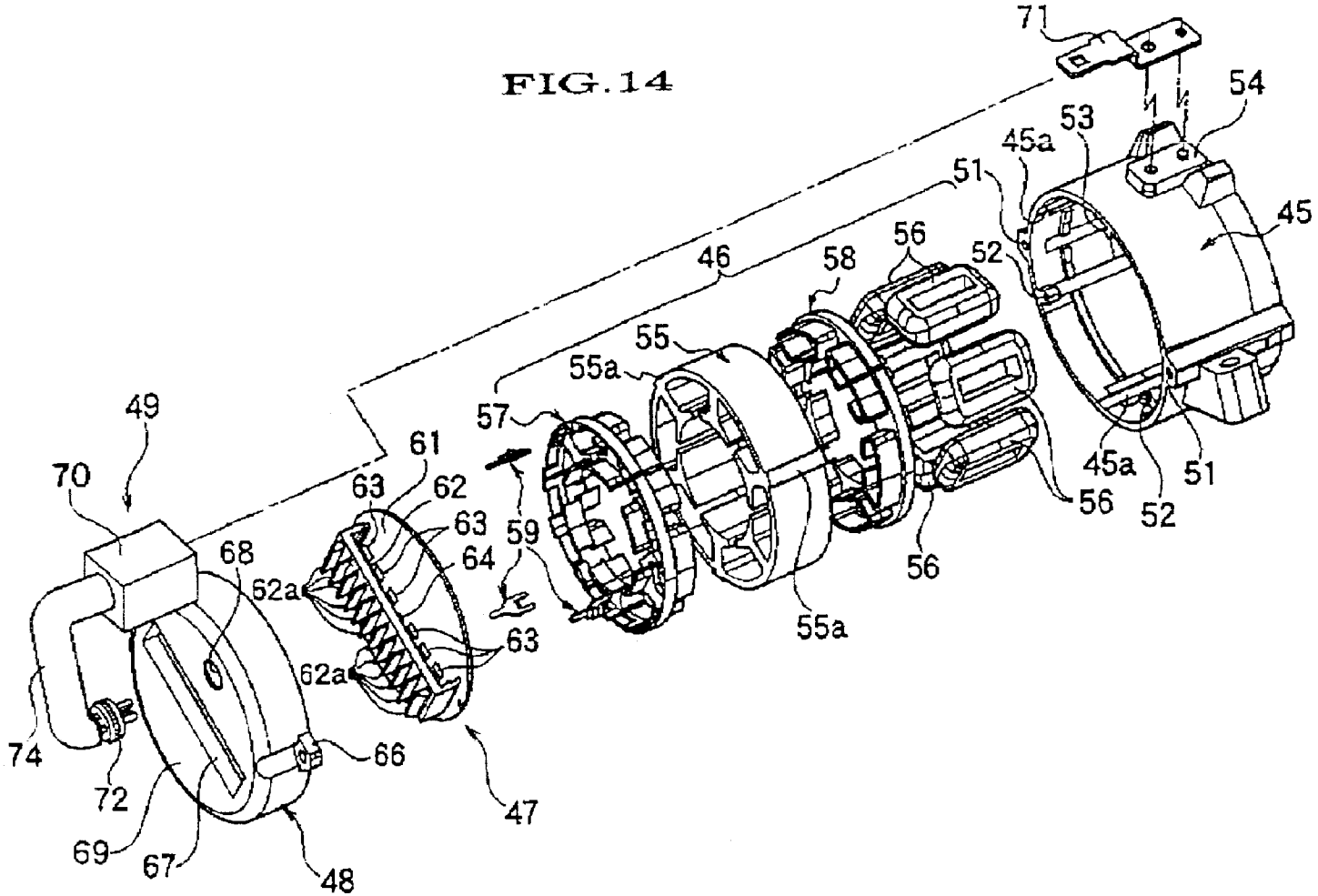
FIG. 14 is an exploded perspective view of the lower assembly shown in FIG. 13.
Figure 15:
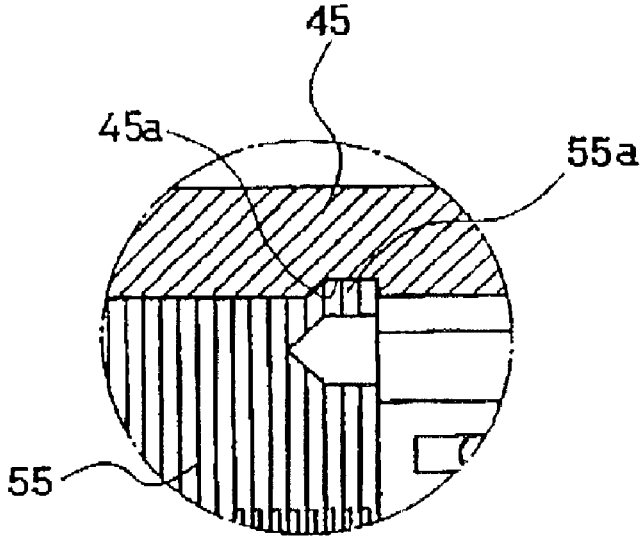
FIG. 15 is an enlarged explanatory view of a portion G in FIG. 2.

As shown in FIGS. 2 and 14, the lower assembly 3 comprises a hollow cylindrical housing 45, a stator assembly 46 contained in the housing 451 a circuit assembly 47, an end cover 48 and a harness assembly 49. The end cover 48 is attached to the housing 45 as described hereinafter.

The housing 45 is formed by die-casting of aluminum and has at its inside grooves 45*a* in which projections 55*a* of a core 65 as described below can be inserted. A distance between the bottom surface of each groove 45*a* and the central axis of the housing 45 is different along the axial direction of the housing.

More specifically, the distance is large at the opposite ends of the housing 46 than an intermediate portion between the opposite ends.

The distance is more less at a position in the side of the end cover 48 to form a protuberance as lock means for the core. When the core 55 is contained in the housing with insertion of the projections 55*a* of the core 55 into the grooves 45*a* of the housing 45, at the final step of insertion, the end of each projection in the side of the end cover 48 proceeds over the protuberance and thus the end of the projection is engaged with the protuberance to lock the core in the housing, thus to prevent the core from removing out of the housing (see FIG. 15).

Provided on an outer circumferential wall at an end portion of the housing 45 in the side of the end cover 48 are two female threaded portions 51 in which bolts 50 are screwed to fasten the end cover 48 to the housing 45. The housing also has on an inner circumferential wall at the same end portion two female threaded portions 52 in which bolts (not shown) are screwed to support assembled insulators 57 and 58 and a seat 53 which acts to lay temporarily the assembled insulators 57 and 58.

The female threaded portions 52 and seat 53 are spaced mutually by angle of 120 degree circumferentially of the housing 45. Formed on an outer side of an end of the housing 45 remote from the end cover 48 a bank 54 to which a connector bracket 71 of a harness assembly 49 is calked by heating.

The stator assembly 46 is composed of the core 55, coils 56 wrapped on the core 55, the insulators 57 and 58. One insulator 57 is provided with three terminal pins 59.

The circuit assembly 47 comprises a substrate 61 made of epoxy material including glass fibers, a heat sink 62 which is attached to the substrate 61 and which formed by extrusion of aluminum, and a power control semi-conductor, for example, MOS type FET (Metal Oxide Semi-Conductor type Field Effect Transistor(s)) 63 mounted on a surface of the substrate in the side of the end cover 48. The number of the MOS type FET may be selected optionally from one or more. A through hole 64 is provided at the center of the substrate 61.

The heat sink 62 covers the MOS type FET from the side of the end cover 48. A surface of the heat sink 62 in the side of the end cover 48 is provided with heat radiating means for cooling the MOS type FET. The heat radiating means is composed of a plurality of fins 62*a* in the embodiment as shown in FIG. 14. Heat radiated from the MOS type FET is cooled by the heat sink. Cooling means is further provided for cooling the heat sink 62. The cooling means is composed of a window 67 formed in the end cover 48 to expose the fins to the atmosphere in the sown embodiment. With the cooling means, it is possible to further enhance capability of cooling of the MOS type FET.

Heat conductivity of the heat sink 62 is, for example, 210 w/m·k of more two times comparing with that of the end cover, 100 w/m·k.

In one embodiment, when the end cover is attached to the housing, the fins are inserted in the window of the end cover and a leading end of each of the fine 62*a* is flush with an outer surface of the end cover or locates in the window by 1 mm from the outer surface of the end cover. In the embodiment, the leading ends of the fins are disposed in the window. The terminal pins 59 spaced circumferentially of the housing 45 with angle of 120 degree are engaged with the substrate 61 in the vicinity of an outer circumferential portion thereof, thereafter, are welded to the substrate. The portions with which the pins are engaged are formed with openings in which a source of two NOS type FET and a drain are inserted and connected electrically trough the terminal pins 59 to the substrate. Gates of the MOS type FET are grounded on the substrate.

A clearance is provided between the base of the poisoning pin 19 and the substrate 61. The conical positioning pin 19 provided on the lower case 4 can be inserted in the through hole 64 of the substrate 61. Again, the positioning pin 19 acts as the gate of melted resin when the lower case of synthetic resin is formed. A groove 19*a* is formed around the base of the positioning pin 19.

The substrate 61 is equipped with at one surface, namely at the surface facing to the end cover 48 a power control circuit including a condenser, a coil and the MOS type FET and so on and at the other surface, namely, at the surface facing to the insulator 57 an integrated circuit which is a signal control circuit. The heat sink 62 is adapted to cover the power control circuit.

Consequently, the power control circuit radiating a great deal of heat is separated from the integrated circuit by means of the heat sink 62 to not transmit the heat to the integrated circuit.

The end cover 48 is formed by die-casting of aluminum and is provided with supporting portions 66 through which the bolts 50 are screwed in the female threaded portions 51 of the housing 45 and a through hole 68 for inserting a grommet 72 of the harness assembly 49.

The harness assembly 49 is composed of the connector 70, the connector bracket 71, the grommet 72, harnesses 73 and, covers 74 for covering the harnesses 73.

To assemble the canned pump, the stator assembly 46 including the core 56 and insulators 57 and 58 is contained in the housing 45 with the projections 55*a* of the core 55 are inserted into the grooves 45*a* of the housing 45 and the upper assembly 2 including the lower case 4 and rotor 7 and the upper case 5 are attached to the housing 45.

Subsequently, the circuit assembly 47 including the substrate 61, MOS type FET 63 and heat sink 62 for covering the MOS type FET is supported on the stator assembly 46 attached to the housing 45.

In this case, the positioning pin 19 provided on the lower case 4 is inserted into the through hole 64 of the substrate 61 and the source and so on of the MOS type FET 63 are engaged with the terminal pins 59 provided on the insulator 57 of the stator assembly 46.

Next, the end cover 48 is attached to the housing 45 to cover the heat sink 62 to form the canned pump.

In the aforementioned embodiments, an inner surface at the window 67 of the end cover 48 is provided with one or more ribs of projecting slightly from the inner surface as shown in FIG. 2. In this case, the ribs are adapted to extend to a position close to the substrate 61 to surround the heat sink 62.

With such construction, the ribs block directly heat radiated from the heat sink or its circumference to protect an electrolytic condenser having low rating of temperature and so on from the heat. The rigs can also guard a noise generated from the MOS type FET 63, together with the heat sink to thus eliminate radio noise.

In the shown embodiment, although the lower case and housing are separately formed, they may be integrally formed, for example, by die-casting. If the lower case and housing are integrally formed, thermal of the substrate is adapted to escape in the side of flowing liquid of the lower case to lower the temperature. It is also possible to block a noise radiated from the side of the impeller 7*a* of the rotor 7 to eliminate the radio noise. It is also possible to lower the produced cost and enhance the waterproofing property, since one or more packings (O rings) disposed between the lower case and housing can be omitted.

Of course, the inner surface of the end cover is not limited to the configuration of ribs, for example, may be formed in a flat state.

According to the present invention, as described above, since the semi-conductor means for power control is attached on the surface of the substrate facing to the end cover and the heat sink for covering the semi-conductor means for power control is mounted on the substrate, it is not necessary to mount the heat sink or any cooling means for cooling, the semi-conductor means on the end cover.

Accordingly, it is possible to produce inexpensively the end cover while maintaining efficiently the cooling of the semiconductor by the heat sink.

Since the power control circuit is attached on one surface of the substrate and the signal control circuit is attached on the other surface of the substrate and the heat sink covers the power control circuit, heat radiated from the power control circuit is not transmitted to the signal control circuit to prevent the signal control circuit from damage of heat.

Since, the cooling means is provided for cooling the heat sink, it is possible cooling positively the power control circuit including the semi-conductor means.

Since the positioning pin of the rotor can be inserted into the through hole of the substrate, it is possible to position easily the substrate to the rotor and assemble precisely the substrate to the rotor.

It is possible to attach firmly and safely the core to the housing since projections of the core are inserted in the grooves of the housing and after the insertion of core, the projections are locked in the grooves.

It is possible to prevent the substrate from floating up since the clearance is provided between the substrate and the base of the positioning pin.

Since the positioning pin has also conical shape, the substrate is constantly stably supported on the lower case in a suitable position to enhance precision of detecting a hole sensor attached to the substrate.

Since the positioning pin is also the gate for the melted resin when the lower case of the rotor is formed by the resin, if surface sink is occurred in the rotor due to heat and so on, it is possible to prevent the positioning pin from deviating.

It is possible to hold the rotor in a correct position if surface sink occurs in the rotor when forming it by correcting the position of the positioning pin due to the groove provided around the base of the positioning pin.

Since the terminal pins of the rotor are welded after they are engaged with the substrate, it is possible to ensure a degree of horizon of the substrate.

It is possible to emit equally heat among the terminal pins of the rotor since the terminal pins are disposed at the equal spaces.

What is claimed is:

1. A canned pump comprising:

a housing;

a rotor contained in said housing;

a circuit substrate supported on said housing, semi-conductor means for power control attached to said circuit substrate;

an end cover attached to said housing for covering said circuit substrate, said circuit substrate disposed between said end cover and said rotor; and a heat sink having heat radiating means for cooling said semi-conductor means for power control, said heat sink disposed between said end cover and said circuit substrate;

wherein said semi-conductor means for power control is mounted on a surface of said circuit substrate facing to said end cover, and said heat sink is attached to said circuit substrate to cover said semi-conductor means for power control.

2. A canned pump according to claim 1, further comprising cooling means for cooling said heat sink.

3. A canned pump according to claim 2, wherein said cooling means comprises a window in said end cover, through which said heat radiating means is exposed to the atmosphere.

4. A canned pump according to claim 1, wherein said heat radiating means of said heat sink comprises a plurality of fins.

5. A canned pump according to claim 4, wherein said fins of the heat sink are inserted into the window of the end cover.

6. A canned pump according to claim 1, wherein said semiconductor means for power control comprises a MOS type FET.

7. A canned pump according to claim 1, wherein a signal control circuit is attached to the surface of said circuit substrate opposite to the surface to which said semi-conductor means for power control is attached.

8. A canned pump according to claim 1, wherein said end cover has ribs extending to a position close to the substrate to surround said heat sink.

9. A canned pump according to claim 1, wherein said rotor is contained in a lower case which is attached to the housing.

10. A canned pump according to claim 9, wherein said lower case is formed integrally with said housing by die-casting.

11. A canned pump comprising:

a housing;

a rotor contained in said housing;

a circuit substrate supported on said housing;

semi-conductor means for power control attached to said circuit substrate;

an end cover attached to said housing for covering said circuit substrate; and a heat sink having heat radiating means for cooling said semi-condutor means for power control;

wherein said semi-conductor means for power control is mounted on a surface of said circuit substrate facing to said end cover, and said heat sink is attached to said circuit substrate to cover said semi-conductor means for power control, wherein said rotor has a positioning pin which is inserted into a through hole provided in said circuit substrate.

12. A canned pump according to claim 11, wherein a clearance between the circuit substrate and a base of the positioning pin is provided.

13. A canned pump according to claim 11, wherein said positioning pin is formed in a conical shape.

14. A canned pump according to claim 11, wherein said positioning pin is a gate of melted resin when forming a resinous water-resistant lower case for said rotor.

15. A canned pump according to claim 11, wherein at least one groove is formed around the base of the positioning pin.

16. A canned pump comprising:

a housing;

a rotor contained in said housing;

a circuit substrate supported on said housings;

semi-conductor means for power control attached to said circuit substrate;

an end cover attached to said housing for covering said circuit substrate; and a heat sink having heat radiating means for cooling said semi-conductor means for power control;

wherein said semi-conductor means for power control is mounted on a surface of said circuit substrate facing to said end cover, and said heat sink is attached to said circuit substrate to cover said semi-conductor means for power control, wherein said housing is formed with at least one seat capable of mounting the circuit substrate thereon and at least one supporting part capable of fixing the circuit substrate thereto.

17. A canned pump comprising:

a housing;

a rotor contained in said housing;

a circuit substrate supported on said housing;

semi-conductor means for power control attached to said circuit substrate;

an end cover attached to said housing for covering said circuit substrate, said circuit substrate disposed between said end cover and said rotor;

a stator assembly which is disposed in said housing and which has a core, and wherein said core has projections which are inserted in grooves formed in the housing, and lock means is provided between said projections and grooves; and a heat sink having heat radiating means for cooling said semi-conductor means for power control, said heat sink disposed between said end cover and said circuit substrate;

wherein said semi-conductor means for power control is mounted on a surface of said circuit substrate facing to said end cover, and said heat sink is attached to said circuit substrate to cover said semi-conductor means for power control.

18. A canned pump comprising:

a housing a rotor contained in said housing;

a circuit substrate supported on said housing;

semi-conductor means for power control attached to said substrate;

an end cover attached to said housing for covering said circuit substrate; and a heat sink having heat radiating means for cooling said semi-conductor means for power control;

wherein said semi-conductor means for power control is mounted on a surface of said circuit substrate facing to said end cover, and said heat sink is attached to said circuit substrate to cover said semi-conductor means for power control, wherein said rotor has a plurality of terminal pins for engaging with circumferential portions of the circuit substrate, after that engagement, the pins are supported on the circuit substrate by welding.

19. A canned pump according to claim 18, wherein said terminal pins are disposed at positions which are spaced at an angle of 120 degrees from each other about a central axis of the housing.

20. A clanned pump comprising:

a housing;

a rotor contained in said housing;

a circuit substrate supported on said housing;

a power control semi-conductor attached to said circuit substrate;

an end cover attached to said housing for covering said circuit substrate, said circuit substrate disposed between said end cover and said rotor; and a heat sink for cooling said power control semi-conductor, said heat sink disposed between said end cover and said circuit substrate;

wherein said power control semi-conductor is mounted on a surface of said circuit substrate facing to said end cover, and said heat sink is attached to said circuit substrate to cover said power control semi-conductor.

* * * * *